US009366266B2

(12) United States Patent
Thrush et al.

(10) Patent No.: US 9,366,266 B2
(45) Date of Patent: Jun. 14, 2016

(54) RECONFIGURABLE GRILLE AND FAN ASSEMBLY INCLUDING RECONFIGURABLE GRILLE

(71) Applicant: Kaz USA, Inc., Southborough, MA (US)

(72) Inventors: Rich Thrush, Jersey City, NY (US); William Fiebel, Succasunna, NJ (US); Adam Sanchez, Nutley, NJ (US); Christopher S. Kanel, Hudson, NY (US)

(73) Assignee: Helen of Troy Limited, St. Michael (BB)

( * ) Notice: Subject to any disclaimer, the term of this patent is extended or adjusted under 35 U.S.C. 154(b) by 584 days.

(21) Appl. No.: 13/827,434

(22) Filed: Mar. 14, 2013

(65) Prior Publication Data

US 2014/0271289 A1 Sep. 18, 2014

(51) Int. Cl.

| | |
|---|---|
| ***F04D 29/56*** | (2006.01) |
| ***F04D 29/46*** | (2006.01) |
| ***F01D 17/16*** | (2006.01) |
| ***F04D 19/00*** | (2006.01) |
| ***F04D 29/70*** | (2006.01) |

(52) U.S. Cl.

CPC ..... *F04D 29/563* (2013.01); *F01D 17/16* (2013.01); *F01D 17/162* (2013.01); *F04D 19/002* (2013.01); *F04D 29/46* (2013.01); *F04D 29/703* (2013.01)

(58) Field of Classification Search

CPC ..... F04D 29/46; F04D 29/563; F04D 29/56; F04D 29/542; F04D 19/002; F04B 17/03; F01B 25/02; F01D 17/12; F01D 17/14; F01D 17/16; F01D 17/162

USPC ..... 415/149.2–149.4, 162, 191, 151, 156, 415/200; 416/247 R

See application file for complete search history.

(56) References Cited

U.S. PATENT DOCUMENTS

| | | | | | |
|---|---|---|---|---|---|
| 2,316,634 | A | * | 4/1943 | Spear | F04D 25/12 454/208 |
| 2,812,900 | A | * | 11/1957 | Matthews | F04D 29/703 150/154 |
| 2,936,109 | A | * | 5/1960 | Copeland | F04D 29/703 415/208.2 |
| 3,371,855 | A | * | 3/1968 | Bruns | F04D 29/526 415/118 |
| 3,450,339 | A | * | 6/1969 | Geoffroy | F04D 29/542 415/148 |
| 3,481,534 | A | * | 12/1969 | Price | F04D 25/10 415/146 |
| 3,883,264 | A | * | 5/1975 | Rao | F01D 1/04 415/119 |
| 4,486,144 | A | * | 12/1984 | Hung | F04D 25/10 415/121.2 |
| 4,521,153 | A | * | 6/1985 | Morimoto | F04D 25/10 415/143 |

(Continued)

*Primary Examiner* — Alexander Comley

(74) *Attorney, Agent, or Firm* — Stroock & Stroock & Lavan LLP

(57) ABSTRACT

A reconfigurable grille for use in association with an axial fan, and a fan assembly including the reconfigurable grille. The reconfigurable grille includes a central hub, an outer rim, and a plurality of vanes each extending from the central hub to the outer rim. The plurality of vanes are configured to switch between at least a first configuration and a second configuration, for example, by a rotation of the central hub relative to the outer rim. The grille can further include a control element to switch the vanes between different configurations.

23 Claims, 3 Drawing Sheets

(56) References Cited

U.S. PATENT DOCUMENTS 4,872,399 A * 10/1989 Chaney ..... F04D 25/08 454/210
4,927,324 A * 5/1990 Coup ..... F04D 29/703 415/121.2
5,118,252 A * 6/1992 Chaney ..... F04D 29/703 415/119
5,131,810 A * 7/1992 Wang ..... F04D 25/10 415/208.1
6,364,618 B1 * 4/2002 Moreno ..... F04D 29/703 403/13
6,394,766 B1 * 5/2002 Gill ..... F04D 29/563 415/148
6,503,060 B1 * 1/2003 Kamada ..... F04D 29/542 415/121.2
6,764,277 B2 * 7/2004 Somahara ..... F04D 29/703 415/121.2
7,018,175 B2 * 3/2006 Horng ..... F04D 29/541 257/E23.099
7,172,387 B2 * 2/2007 Yamamoto ..... F04D 29/703 415/119
8,182,218 B2 * 5/2012 Pearce ..... F04D 29/703 415/220
2005/0008478 A1 * 1/2005 Chang ..... F04D 29/542 415/149.2
2006/0257252 A1 * 11/2006 Savage ..... F04D 29/661 415/191
2008/0124234 A1 * 5/2008 Echazarreta ..... F04D 25/08 417/423.14
2013/0064679 A1 * 3/2013 Tsai ..... A01M 1/06 416/247 R

* cited by examiner

RECONFIGURABLE GRILLE AND FAN ASSEMBLY INCLUDING RECONFIGURABLE GRILLE

BACKGROUND OF THE INVENTION

1. Field of the Invention

The present invention generally relates to air-moving devices. In particular, the present invention relates to fan and a reconfigurable grille for use with an axial fan such that different air flow patterns can be produced when the grille is in different configurations.

2. Description of the Related Art

Numerous types of air-moving devices exist on the market, such as fans, humidifiers, air-conditioning units, dehumidifiers, air purifiers, hair driers and the like. Depending on the applications and consumers' preference, these air-moving devices can be designed to produce different patterns of airflow, such as a focused and more laminar stream flow across a room (i.e., a "circulator"), or a gentle and slightly turbulent more close-ranged and spread-out flow. The latter pattern can be preferred by a consumer for cooling in the summer.

A common component of many air-moving devices is a grille placed in front of an axial fan (or axial-flow fan). The grille can help create desired distribution patterns of airflow generated by the fan for the environment in which the product is used. The grille for an axial fan can include a number of vanes configured in certain patterns or geometries for achieving desired airflow direction or deflection. Common configurations of vanes in consumer products include louvers which can control the direction of the airflow, as those found in cars, vents in air conditioning vents, etc., and spirally-configured vanes in certain Honeywell® TurboForce™ series of products. The vanes in these products are generally not reconfigurable. Although the louvers can be moved to change the direction of airflow, the airflow patterns are not changed.

There is a need for a reconfigurable grille for air-moving devices such that a single air-moving device can produce different airflow patterns depending on the configuration of the grille.

SUMMARY OF THE INVENTION

In one aspect, the present invention provides a reconfigurable grille for use in association with an axial fan. The grille includes a central hub, an outer rim, and a plurality of vanes each extending from the central hub to the outer rim. The plurality of vanes are configured to switch between at least a first configuration and a second configuration. In one of the first configuration and second configuration, each of the plurality of vanes includes at least a generally counterclockwise curved portion. In the other of the first configuration and second configuration, each of the plurality of vanes includes at least a generally clockwise curved portion. In some embodiments of the grille, the central hub and the outer rim are configured to rotate relative to each other to switch the plurality of vanes between the first configuration and the second configuration. In other embodiments of the grille, the central hub further includes a control element, upon which when a predetermined action is performed, the plurality of vanes are switched from the first configuration to the second configuration. The control element can include a protrusion such as, but not limited to, a knob, a pull, a push button, a slide, etc., the turning or moving (action) of which can change the vane configurations.

In another aspect, the present invention provides a reconfigurable grille for use in association with an air-moving device (such as a cooling fan or air-conditioning unit), where the reconfigurable grille includes a central hub, an outer rim, a plurality of vanes each extending from the central hub to the outer rim, wherein the central hub and the outer rim are configured to rotate relative to each other to move the plurality of vanes from a first configuration to a second configuration. In some embodiments of the grille, in at least one of the first configuration and the second configuration, each of the plurality of vanes includes at least a similarly curved portion with respect to other vanes. In certain embodiments, in one of the first configuration and the second configuration, each of the plurality of vanes includes at least a generally counterclockwise curved portion, and in the other of the first configuration and the second configuration, each of the plurality of vanes includes at least a generally clockwise curved portion. The plurality of vanes can be in a third configuration different from each of the first configuration and the second configuration, e.g., a configuration that is intermediate between the first configuration and the second configuration. In certain embodiments, the central hub further includes a control element, upon which when a predetermined action is performed, the plurality of vanes are switched from the first configuration to the second configuration. The control element can be further configured to move the plurality of vanes from each of the first configuration and the second configuration into the third intermediate configuration.

In a further aspect, the present invention provides a fan assembly including a fan having at least one blade rotatable about a rotating axis, a housing at least partially enclosing the fan, and a reconfigurable grille mounted on the housing. The reconfigurable grille can be any of the embodiments of the reconfigurable grille as described herein. In some embodiments, the fan assembly further includes a control element for changing the configurations of the vanes, as described herein in connection with the reconfigurable grille. The control element, such as a knob, can be an integral part of the grille, or can be coupled to the central hub of the reconfigurable grille. The outer rim of the grille can be mounted on the housing of the fan. A protective grille can be optionally disposed between the fan and the reconfigurable grille.

In yet a further aspect, the present invention provides a fan assembly which includes: a fan having at least one blade rotatable about a rotating axis, the rotation of the fan generating an airflow; a reconfigurable grille disposed proximate the fan, the reconfigurable grille having a plurality of openings defined by a plurality of vanes permitting at least a portion of the airflow to exit the reconfigurable grille, and the reconfigurable grille switchable between a first configuration and a second configuration, the geometries of the openings in the first configuration being different from the geometries of the openings in the second configuration, wherein the airflow exiting the reconfigurable grille in the first configuration produces a focused laminar flow, and the airflow exiting the reconfigurable grille in the second configuration produces a turbulent splayed flow. The reconfigurable grille can be any of the embodiments of the reconfigurable grille as described herein.

BRIEF DESCRIPTION OF THE DRAWINGS

The various aspects and embodiments disclosed herein will be better understood when read in conjunction with the appended drawings, wherein like reference numerals refer to like components. For the purposes of illustrating aspects of the present invention, there are shown in the drawings certain preferred embodiments. It should be understood, however, that the application is not limited to the precise arrangement, structures, features, embodiments, aspects, and devices shown, and the arrangements, structures, features, embodiments, aspects and devices shown may be used singularly or in combination with other arrangements, structures, features, embodiments, aspects and devices. The drawings are not necessarily drawn to scale and are not in any way intended to limit the scope of this invention, but are merely presented to clarify illustrated embodiments of the invention. In these drawings.

DETAILED DESCRIPTION

For purposes of the following discussion the various embodiments of the fan assembly and the reconfigurable grille are described in connection with a fan, but it will be appreciated that the herein embodied reconfigurable grille may be used for various types of household or industrial air-moving devices, such as cooling fans, humidifiers, air-conditioning units, dehumidifiers, air purifiers, hair driers and the like, that contain axial fans having blades that force air to move parallel to a shaft (the axis about which the blades rotate). The axial fans can be powered by electric motors, but other sources of power may also be used, for example, hydraulic motors and internal combustion engines. A single unit of air-moving device containing the reconfigurable grille can produce different types of airflow patterns based on the different configurations of the grille takes, and thus can serve multiple functions. Furthermore, the fan assembly and the reconfigurable grille can be used for submersible applications, such as in water pumps.

In an embodiment, the present invention provides a reconfigurable grille for use in association with an axial fan. Further, the present invention provides a fan assembly including a fan and a reconfigurable grille. Various embodiments of these aspects are described in further detail below.

Figure 1A:
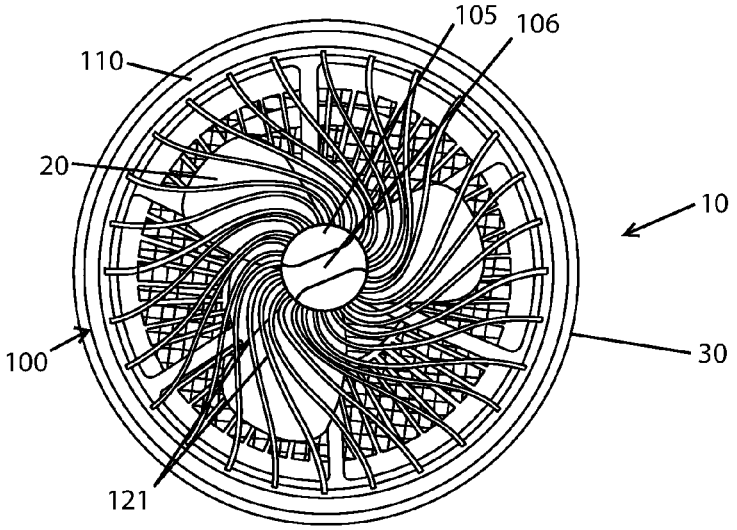
FIG. 1*a* is a front view of a fan assembly including a reconfigurable grille in a first configuration according to some embodiments of the present application.
Figure 1B:
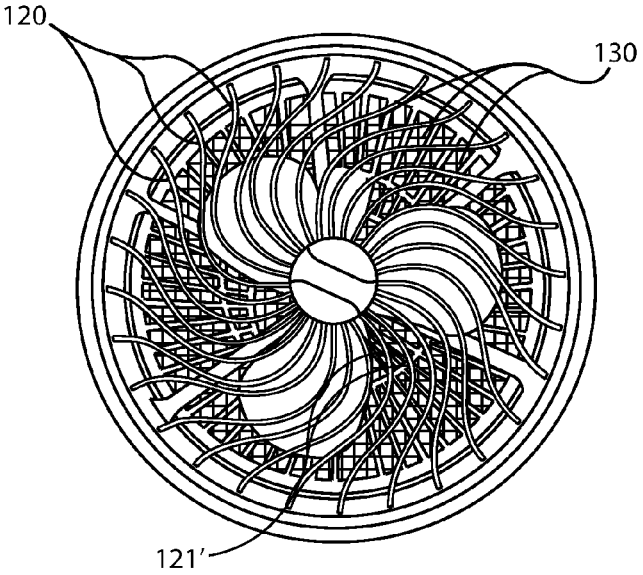
FIG. 1*b* is a front view of a fan assembly including a reconfigurable grille in a second configuration according to some embodiments of the present application.

Referring to FIGS. 1*a* and 1*b*, certain embodiments of a fan assembly of the present invention are illustrated. The fan assembly 10 includes a fan 20, a housing 30 at least partially enclosing the perimeter of the fan 20, and a reconfigurable grille 100 mounted on the housing 30. The reconfigurable grille 100 includes a central hub 105, an outer rim 110, and a plurality of vanes 120 each extending from the central hub 105 to the outer rim 120. The plurality of vanes defines a plurality of openings 130, through which at least a portion of the airflow generated by the axial fan can pass through. When the openings of the grille are large such that a finger or hand of a consumer can go through, a protective grille (not shown) can be optionally disposed between the fan and the grille to prevent accidental injuries to the consumer.

As shown in FIGS. 1*a* and 1*b*, the vanes of the grille can be reversibly switched between different configurations, which cause a change in the geometries of the openings 130. (Such change can impact the airflow pattern exiting the openings, as will be further described below.) For example, the central hub 105 and the outer rim 110 can be configured to rotate relative to each other to move the plurality of vanes from a first configuration (e.g., as shown in FIG. 1*a*) to a second configuration (e.g., as shown in FIG. 1*b*), and vice versa. For example, in one or both of the first configuration and the second configuration, each of the plurality of vanes 120 can include at least a similarly curved portion. As shown in FIG. 1*a*, in a first configuration of the vanes, each of the vanes includes at least a generally counterclockwise curved portion 121; and as shown in FIG. 1*b*, in a second configuration, each of the vanes includes at least a generally clockwise curved portion 121'.

As described herein, the configurations assumed by the vanes (or a portion thereof) of the grille mean the general arrangement of the pattern profiles of the vanes as projected on an imaginary plane normal to the rotating axis of the fan, and as observed at a vantage point in front of the grille. As the thickness of the vanes is thin compared to the size of the openings defined between the vanes, the center lines of the cross-sectional profiles of the vanes can be used as the curves for evaluating the geometry of the vanes. As used herein, the direction of the curves for the vanes is considered in terms of the direction the vanes bend as the curves extend from the central hub to the outer rim. For example, the vanes in FIGS. 1*a* and 2*a* include curved portions that assume a generally counterclockwise direction, whereas the vanes in FIGS. 1*b* and 2*b* include curved portions that assume a generally clockwise direction.

Figure 2A:
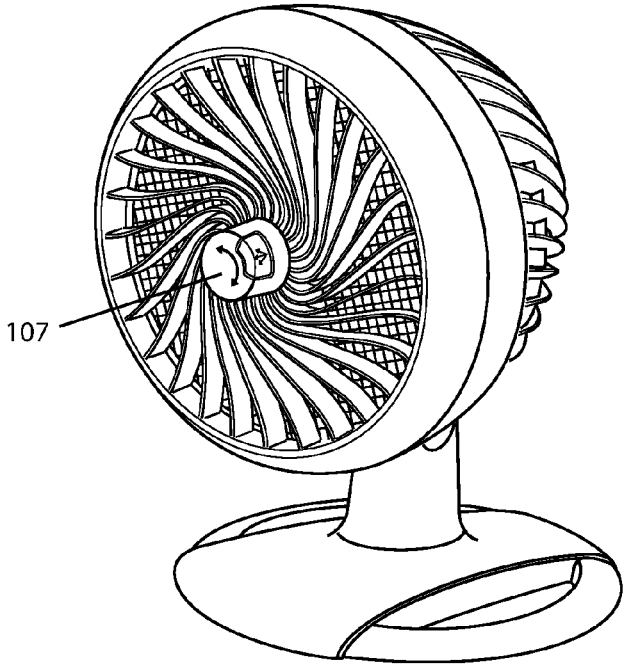
FIG. 2*a* is a perspective view of a fan assembly including a reconfigurable grille in a first configuration according to some embodiments of the present application.
Figure 2B:
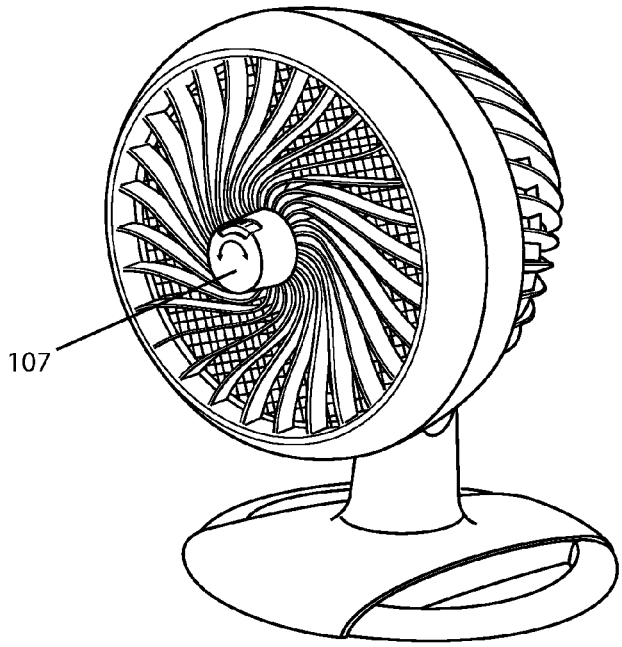
FIG. 2*b* is a perspective view of a fan assembly including a reconfigurable grille in a second configuration according to some embodiments of the present application.

The vanes in the first configuration can be switched to the second configuration by a control element. When a predetermined action is performed upon the control element, the plurality of vanes are switched from one configuration to the other configuration. For example, and as illustrated in FIGS. 1*a* and 1*b*, the central hub can include an elongated protruding portion 106, and the turning of this control element (clockwise or counterclockwise) to predetermined positions can change the configurations of the vanes. Alternatively, as illustrated in FIGS. 2*a* and 2*b*, the central hub can include an elevated knob, and the turning of the knob can change the configuration of the vanes. Although not shown, other mechanisms for the control element can be employed, as will be appreciated by one skilled in the art, such as a slider. The control element can also be placed on the perimeter of the fan, e.g., on the housing of the fan, or remotely, rather than on the central hub. Further, electrical components can be included to enable the control element to be responsive to a simple touch of a button, thereby effecting the rotation of the hub. The reconfigurable grille or the fan assembly can further include a second control element to adjust the distance between the vanes and the fan blades to create different airflow patterns.

While it is shown in these figures that the control element can be an integral part of the hub, it is understood that the control element can also be separately manufactured and coupled to the hub to perform its function. In this regard, it is understood that the hub can be made with an appropriate configuration, e.g., with a depression, with an engaging element, or in the form of a hollow ring, such that the control element can be easily and securely fitted onto the hub. The hub can further be mounted on a fan shaft, or on a protective grille interposed between the reconfigurable grille and the fan blades. Due to the elasticity of the material chosen and their geometries relative to the cross-section of the grille, the vanes can hold the desired configurations by themselves (i.e., they are bi-stable by design), although retention mechanisms (such as a coupling between the hub and the fan shaft/protective grille) also be used to readily hold the vanes in other different configurations. The hub can be made with various shapes and materials as desired. In some embodiments, the center of the hub can be aligned with the rotating axis of the fan. Further, the hub need not have an extended solid area, but can simply include structures or joints where the vanes meet or are otherwise coupled together.

The configurable grille can be mounted onto the housing of the fan. As shown in FIGS. 1*a*, 1*b* and 2*a*, 2*b*, this can be achieved by integrating the outer rim of the grille with the housing of the fan. In this manner, the outer rim of the grille can be viewed as a part of the housing of the fan. Alternatively, the outer rim can be appropriately configured to couple with the housing of the fan, for example, with commonly used mounting elements, such as tabs, hooks, latches, screws, and the like. The outer rim can also be slidably mounted onto the fan housing such that it can rotate relative to the central hub when the central hub is held in place.

As shown in FIGS. 1*a*, 1*b* and 2*a*, 2*b*, the vanes of the reconfigurable grille are deformable so as to assume different configurations in response to the action applied on the control element. For example, the vanes can be made from a flexible material, such as rubber, soft plastic, fabric, or the like. Alternatively, the deformable vanes can be made of a more rigid plastic or a semiflexible metal. It is desirable that the material for the vanes has good durability for repeated bending and flexing. Further, the vanes can also be made with hard or soft segments connected with flexible links. The thickness and/or the width (or depth) of the vanes can be selected as appropriate based on the desired flexibility of the vanes, among other considerations. Further, the thickness and/or the width of the vanes can be varied within each of the vanes and/or across the plurality of vanes. The number of the vanes, the radial distribution of the vanes around the central hub, the lengths of the vanes, and specific curves assumed by the vanes between the hub and the outer rim can all be selected to create different airflow results for a user.

Although only two example configurations are shown in FIGS. 1*a* and 1*b*, it is appreciated that the vanes can take configurations other than these two configurations as shown. These alternative configurations can be created, for example, by specific structural designs or material choice of the vanes. In addition, the vanes can be in various intermediate configurations between the two configurations as depicted in FIGS. 1*a* and 1*b*, or in configurations beyond those depicted in FIGS. 1*a* and 1*b*. These other configurations can be obtained by, for example, by rotating the control element 106 clockwise or counterclockwise to predetermined positions, where the configurations of the vanes can be held using detents or other locking mechanisms commonly known in the art.

The vanes can be manufactured, e.g., molded, as a one piece structure integral with the central hub and/or the outer rim. Alternatively, the vanes can be manufactured separately from the hub and/or outer rim, and later fixedly, pivotally, or otherwise coupled with the hub and/or the outer rim. For example, the vanes can be coupled to the hub in a variety of ways, such as pinned to the hub, trapped in a two-part hub, heat staked to the hub, screwed to the hub, and the like To increase visual appeal of the grille, selected portions of the vanes can be painted with a color or pattern different from the remaining parts of the vanes.

As shown in FIGS. 1*a*, 1*b* and 2*a*, 2*b*, the grille can be of approximately round cross section. Other cross sections can be selected as desired or needed, e.g., based on the shape of the fan housing, other fan specifications, or requirements of applications. Further, the grille can be made such that it can be mounted to the housing of the fan on both sides, for example, by equipping the grille with mounting elements on both sides.

Figure 3A:
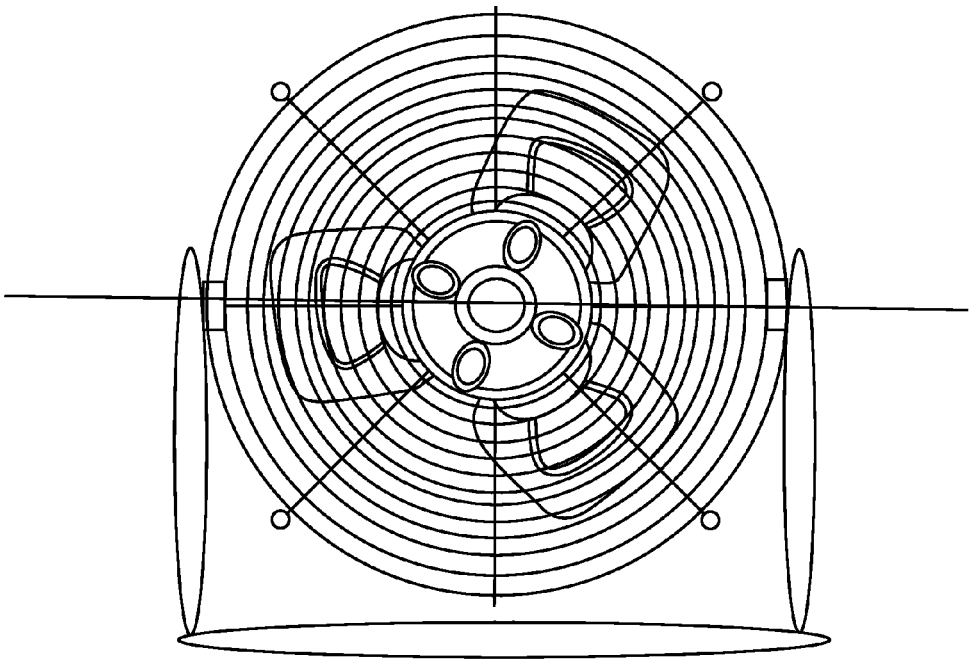
FIG. 3*a* is a schematic front view of a test fan including a reconfigurable grille according to some embodiments of the present application.
Figure 3B:
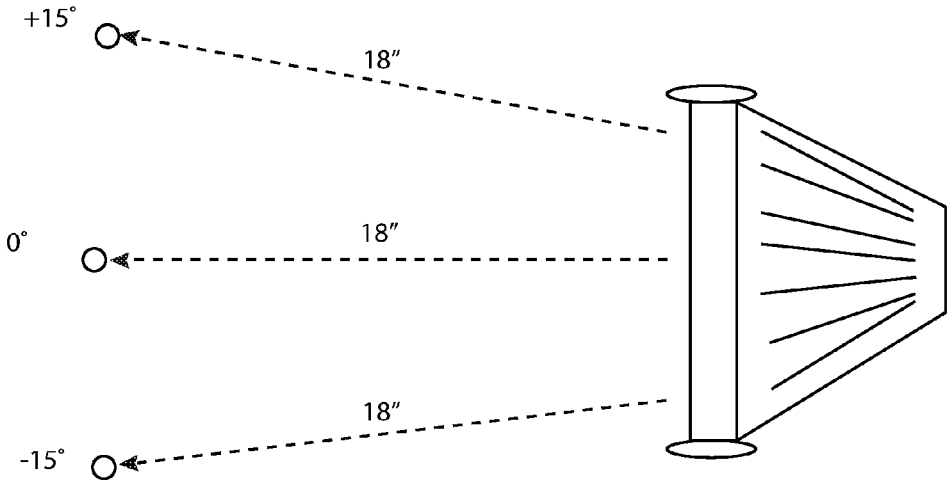
FIG. 3*b* is a schematic top view of a setup for airflow measurements for a test fan including a reconfigurable grille according to some embodiments of the present application.

As noted above, at different configurations, the reconfigurable grille can help create different airflow patterns for an axial fan, as demonstrated by the following example. In this example, a commercial Honeywell® HT900 TurboForce fan product was refitted with a reconfigurable grille (whose vanes, central hub, and outer rime are molded as one integral piece from a rubber material) of an embodiment of the present invention as shown in FIGS. 1*a* and 1*b* (the original grille that comes with the HT900 was removed), and airflow tests were performed on the refitted test fan. FIG. 3*a* is a schematic front view of the test fan (reconfigurable grille not shown). The diameter of the cross-section of the fan (including the outer housing) is about 9.5 inch, i.e., about 24 cm. The airflow measurements were performed on the horizontal plane of the motor axis. FIG. 3*b* is a schematic top view of the test setup, showing that the measurements were taken at three locations, each spaced from the grille at a distance of about 18 inch, i.e., about 46 cm. A first location is aligned with the rotating axis of the fan (denoted 0°); the second location is slightly outside the left edge of the fan housing at an angle of 15° (denoted)+15°; and the third location is slightly outside the right edge of the fan housing at an angle of 15° (denoted −15°). The fan has two power level settings: "low" and "high". In the high setting, the fan blade spins at a higher speed. When turned on, the fan blades turn clockwise when viewed from the front of the fan. The measurement results (in cubic feet per minute) are presented in the following table.

| Power Level Setting | Measurement Location | Airflow when the grille is in a generally counterclockwise configuration (shown in FIG. 1a) (CFM) | Airflow when the Grille is in a generally clockwise configuration (shown in FIG. 1b) (CFM) |
|---|---|---|---|
| Low | +15° | 0 | 1.0 |
| Low | 0° | 2.2 | 1.2 |
| Low | −15° | 0 | 1.7 |
| High | +15° | 0 | 1.3 |
| High | 0° | 2.7 | 1.7 |
| High | −15° | 0 | 2.3 |

The measurement results in the table above show that when the grille is in the generally counterclockwise configuration, the airflow exiting from the grille produces a focused laminar flow, whereas when the grille is in the generally clockwise configuration, the airflow exiting from the grille produces a turbulent splayed flow. The former configuration of the grille therefore can be suitable for moving the air over a greater distance, while the latter configuration of the grille can provide a consumer closed-ranged, scattered, and natural wind-mimicking flow for cooling comfort.

While not wishing to be bound by any particular theory, it is believed that the above results can be explained as follows. A rotating axial fan free of flow deflecting objects in its front will produce an airflow that has a helical component. When the configuration of the vanes in the grille aligns with the helical flow, the grille can help the flow to be focused and straight. When the configuration of the vanes in the grille misaligns with, e.g., runs opposite to the helical flow, the grille disrupts the flow and sends it in dispersed directions.

The present invention is not to be limited in scope by the specific embodiments described herein. Various modifications of the invention in addition to those described herein will become apparent to those skilled in the art from the foregoing description and the accompanying figures. Such modifications are intended to be encompassed within the scope of the appended claims.

What is claimed is:

1. A reconfigurable grille for use in association with an axial fan, comprising: a central hub; an outer rim; and a plurality of vanes each extending from the central hub to the outer rim, the plurality of vanes configured to bend or deform so as to switch between at least a first configuration and a second configuration, wherein in one of the first configuration and the second configuration, each of the plurality of vanes curves in one of a generally clockwise or counterclockwise direction from the central hub to the outer rim, and in the other of the first configuration and second configuration, each of the plurality of vanes curves in the other of the a-generally clockwise or counterclockwise direction from the central hub to the outer rim; and a control element configured to selectively control switching between at least the first configuration and the second configuration and to maintain the vanes in a selected one of at least the first configuration and the second configuration; wherein the central hub comprises the control element, upon which when a predetermined action is performed, the plurality of vanes are switched from the first configuration to the second configuration.

2. The reconfigurable grille of claim 1, wherein the central hub and the outer rim are configured to rotate relative to each other to switch the plurality of vanes between the first configuration and the second configuration.

3. The reconfigurable grille of claim 1, wherein the control element includes a knob.

4. The reconfigurable grille of claim 1, wherein each of the plurality of vanes includes a flexible material.

5. The reconfigurable grill of claim 1, wherein the plurality of vanes, the central hub, and the outer rim are molded as one integral piece from a rubber material.

6. The reconfigurable grille of claim 1, wherein the outer rim of the grille is configured to mount on a housing of the fan.

7. The reconfigurable grille of claim 1, wherein the plurality of vanes each comprises a portion colored differently from another portion of the vane for visual enhancement.

8. The reconfigurable grille of claim 1, wherein the plurality of vanes are further configured to switch between each of the first configuration and the second configuration and a third configuration, the third configuration being intermediate each of the first configuration and the second configuration.

9. A reconfigurable grille for use in association with an air-moving device, comprising: a central hub; an outer rim; and a plurality of vanes each extending from the central hub to the outer rim, wherein the central hub and the outer rim are configured to rotate relative to each other to bend or deform the plurality of vanes from a first configuration to a second configuration: and a control element configured to selectively control switching between at least the first configuration and the second configuration and to maintain the vanes in a selected one of at least the first configuration and the second configuration; wherein the central hub comprises the control element, upon which when a predetermined action is performed, the plurality of vanes are switched from the first configuration to the second configuration and held in the switched first configuration or second configuration.

10. The reconfigurable grille of claim 9, wherein in at least one of the first configuration and the second configuration each of the plurality of vanes comprises at least a similarly curved portion with respect to other vanes.

11. The reconfigurable grille of claim 9, wherein in one of the first configuration and the second configuration each of the plurality of vanes comprises at least a curved portion curved in one of a generally clockwise or counterclockwise direction from the central hub to the outer rim, and in the other of the first configuration and the second configuration, each of the plurality of vanes comprises at least a curved portion curved in the other of the generally clockwise or counterclockwise direction from the central hub to the outer rim.

12. The reconfigurable grille of claim 9, wherein the plurality of vanes are further configured to switch between each of the first configuration and the second configuration and a third configuration, the third configuration being intermediate the first configuration and the second configuration.

13. The reconfigurable grille of claim 9, wherein the air-moving device is a cooling fan.

14. The reconfigurable grille of claim 9, wherein the air-moving device is an air-conditioning unit.

15. A fan assembly, comprising: a fan having at least one blade rotatable about a rotating axis; a housing at least partially enclosing the fan; and a reconfigurable grille mounted on the housing, the reconfigurable grille including: a central hub, an outer rim, a plurality of vanes each extending from the central hub to the outer rim, the plurality of vanes configured to bend or deform so as to switch between at least a first configuration and a second configuration, wherein in one of the first configuration and second configuration, each of the plurality of vanes comprises at least a portion curved in one of a generally clockwise or counterclockwise direction from the central hub to the outer rim, and in the other of the first configuration and second configuration, each of the plurality of vanes comprises at least a portion curved in the other of the generally clockwise or counterclockwise direction from the central hub to the outer rim, and a control element configured to selectively control switching between at least the first configuration and the second configuration and to maintain the vanes in a selected one of at least the first configuration and the second configuration; wherein the central hub comprises the control element, upon which when a predetermined action is performed, the plurality of vanes are switched from the first configuration to the second configuration.

16. The fan assembly of claim 15, wherein the central hub and the outer rim of the reconfigurable grille are configured to rotate relative to each other to switch the plurality of vanes between the first configuration and the second configuration.

17. The fan assembly of claim 15, further comprising a second control element for adjusting a distance between the plurality of vanes and the fan.

18. The fan assembly of claim 15, wherein the control element includes a knob.

19. The fan assembly of claim 15, wherein the outer rim of the grille is mounted on the housing of the fan.

20. The fan assembly of claim 15, further comprising a protective grille disposed between the fan and the reconfigurable grille.

21. A fan assembly, comprising: a fan having at least one blade rotatable about a rotating axis, the rotation of the fan generating an airflow; a reconfigurable grille disposed proximate the fan, the reconfigurable grille comprising a central hub, an outer rim, and a plurality of vanes each extending from the central hub to the outer rim, a plurality of openings defined by the plurality of vanes permitting at least a portion of the airflow to exit the reconfigurable grille, and the reconfigurable grille bendable or deformable so as to switch between a first configuration and a second configuration, geometries of the openings in the first configuration being different from geometries of the openings in the second configuration; and a control element configured to selectively control switching between at least the first configuration and the second configuration and to maintain the vanes in a selected one of at least the first configuration and the second configuration, wherein airflow exiting the reconfigurable grille in the first configuration produces a focused laminar flow, and airflow exiting the reconfigurable grille in the second configuration produces a turbulent splayed flow, and wherein the central hub comprises the control element, upon which when a predetermined action is performed, the plurality of vanes are switched from the first configuration to the second configuration.

22. The fan assembly of claim 21, wherein in the one of the first configuration and the second configuration, each of the plurality of vanes comprises at least a portion curved in one of a generally clockwise or counterclockwise direction from the central hub to the outer rim, and in the other of the first configuration and the second configuration, each of the plurality of vanes comprises at least a portion curved in the other of the generally clockwise or counterclockwise direction from the central hub to the outer rim.

23. The fan assembly of claim 22, wherein the central hub and the outer rim of the reconfigurable grille are configured to rotate relative to each other to switch the plurality of vanes between the first configuration and the second configuration.

* * * * *